US006565282B1

(12) United States Patent
Gray

(10) Patent No.: US 6,565,282 B1
(45) Date of Patent: May 20, 2003

(54) TRACTOR IMPLEMENT FOR SCARRING PAVEMENT IN PAINT LINE REMOVAL

(75) Inventor: Carey Gray, Spanaway, WA (US)

(73) Assignee: Apply-A-Line, Inc., Pacific, WA (US)

( * ) Notice: Subject to any disclaimer, the term of this patent is extended or adjusted under 35 U.S.C. 154(b) by 0 days.

(21) Appl. No.: 10/075,148

(22) Filed: Feb. 14, 2002

(51) Int. Cl.[7] ..... E01C 23/16; E01C 23/20

(52) U.S. Cl. ..... 404/94; 404/91; 299/39.9; 299/39.1

(58) Field of Search ..... 404/90, 91, 93, 404/94, 92; 299/36.1, 39.1, 39.2, 39.9, 39.4, 39.6

(56) References Cited

U.S. PATENT DOCUMENTS

| | | | | | |
|---|---|---|---|---|---|
| 5,215,071 | A | * | 6/1993 | Mertes et al. | 125/13.01 |
| 5,415,495 | A | * | 5/1995 | Johnson | 404/84.05 |
| 5,605,381 | A | * | 2/1997 | Schmoock et al. | 299/39.2 |
| 5,890,772 | A | * | 4/1999 | Mravyan | 175/374 |
| 6,203,112 | B1 | * | 3/2001 | Cook et al. | 125/13.01 |

* cited by examiner

*Primary Examiner*—Robert E. Pezzuto
*Assistant Examiner*—Alexandra K. Pechhold
(74) *Attorney, Agent, or Firm*—David L. Tingey

(57) ABSTRACT

A tractor implement to grind surface pavement in removing paint lines is mounted on a tractor side and driven by a tractor power take-off. An implement first frame is supported rotatably on a rod extending orthogonally from the tractor. A rotatable tractor control mechanically connected to the implement first frame causes it to rotate on the rod, therein providing an implement adjustment in pitch and lifting and lowering the implement between a travel position and an operational position. The implement first frame connects pivotably to an implement second frame. A first hydraulic cylinder on the implement first frame parallel the rod connects to the implement second frame such that actuation of the first hydraulic cylinder causes the implement second frame to pivot about a second frame central axis therein providing the second frame an adjustment in roll. A grinding brush is mounted transversely to the implement second frame. In its operational position, the implement is lowered in pitch onto a guide wheel that supports the implement at its forward end.

12 Claims, 5 Drawing Sheets

TRACTOR IMPLEMENT FOR SCARRING PAVEMENT IN PAINT LINE REMOVAL

BACKGROUND

This invention relates generally to pavement grinder machines, and more particularly to machines for scarring a pavement surface, advantageous in paint line removal.

It is commonplace to have painted lane lines on paved roads. As conditions change, it is often necessary to remove these paint lines. Machines exist that remove paint lines by grinding the surface of pavement in sufficient depth to include the paint lines. However, it is typical that these machines unnecessarily scar the pavement because the machine grinder is not parallel with the road surface. That is, the grinder is not adjustable to track the curvature of the paved road.

SUMMARY

One object of the present invention is to provide a pavement scarring machine that adjusts to the curvature of the paved road beneath so that only the pavement surface is ground at a uniform depth sufficient only to remove pavement paint lines. Another object is to provide such a machine as a tractor implement driven by a tractor power take-off therein providing a vehicle frame commercially available at minimal cost easily adapted as a scarifying machine. A further object is to provide such a cutting machine implement that can be lowered into operational position for scarifying or lifted from underlying pavement and carried by the drive vehicle during nonuse. A final object is to provide height adjustment of a grinder within the implement while the implement is in operational position between a first, or noncontact position when the grinder is in noncontact with underlying pavement and a second, or grinding position when the grinder is lowered a measured depth into underlying pavement.

These objects are achieved in a pavement scarifying machine mounted on a rubber-wheeled tractor as a tractor implement driven by the tractor power take-off, typically from a power take-off position on the tractor side. The implement is supported from a tractor secondary frame that is added under the tractor primary frame. An implement first frame is rotatably supported on a cylindrical rod extending orthogonally from the tractor secondary frame. A first frame lever is mechanically connected to a tractor implement control that rotates the lever on operator command, therein rotating the implement first frame. Rotation of implement. It is common for a tractor to be equipped with such an implement control as standard equipment to rotatably control a side-mounted implement generally, such as a lawn mower, lifting and lowering the implement into and out of an operational position.

An implement second frame is pivotably connected to the implement first frame on a frame pivot pin axially aligned orthogonal to the cylindrical bar and longitudinal with tractor movement. A first hydraulic cylinder mounted on the first frame parallel to the cylindrical rod connects to the second frame at its rearward end. Actuation of the first hydraulic cylinder therein adjusts the roll position of the second frame.

When the implement is lowered into its operational position by the implement control, it then freely floats rotatably in pitch on the cylindrical bar with the cylindrical bar supporting the implement at its rearward end. A guide wheel supports the implement at its forward end to limit pitch movement so the implement is prevented from excessively penetrating into pavement below. The implement is finely adjusted in pitch while in operational position between noncontact with underlying pavement and a grinding contact with underlying pavement by support action of the guide wheel. This adjustment is achieved with the guide wheel mounted on an implement auxiliary frame that vertically pivots on the implement second frame by action of a second hydraulic cylinder within the implement effectively changing the height of the guide wheel relative to the primary frame. Thus, the grinding brush moves between engagement and nonengagement with underlying pavement as it is supported by the vertically-pivoting second frame. (For purposes herein, the term "grinder brush" or "brush" is not limited to bristle configurations but is meant generally to include all devices for and methods of grinding pavement.)

The implement extends outward of the track of the tractor wheels from the tractor side so the grinder brush can reach beyond the travel of the tractor wheels where an operator can view the operation of implement on a paint line directly alongside and the tractor wheels do not travel on scarred pavement.

DETAILED DESCRIPTION OF THE PREFERRED EMBODIMENT

Figure 1:
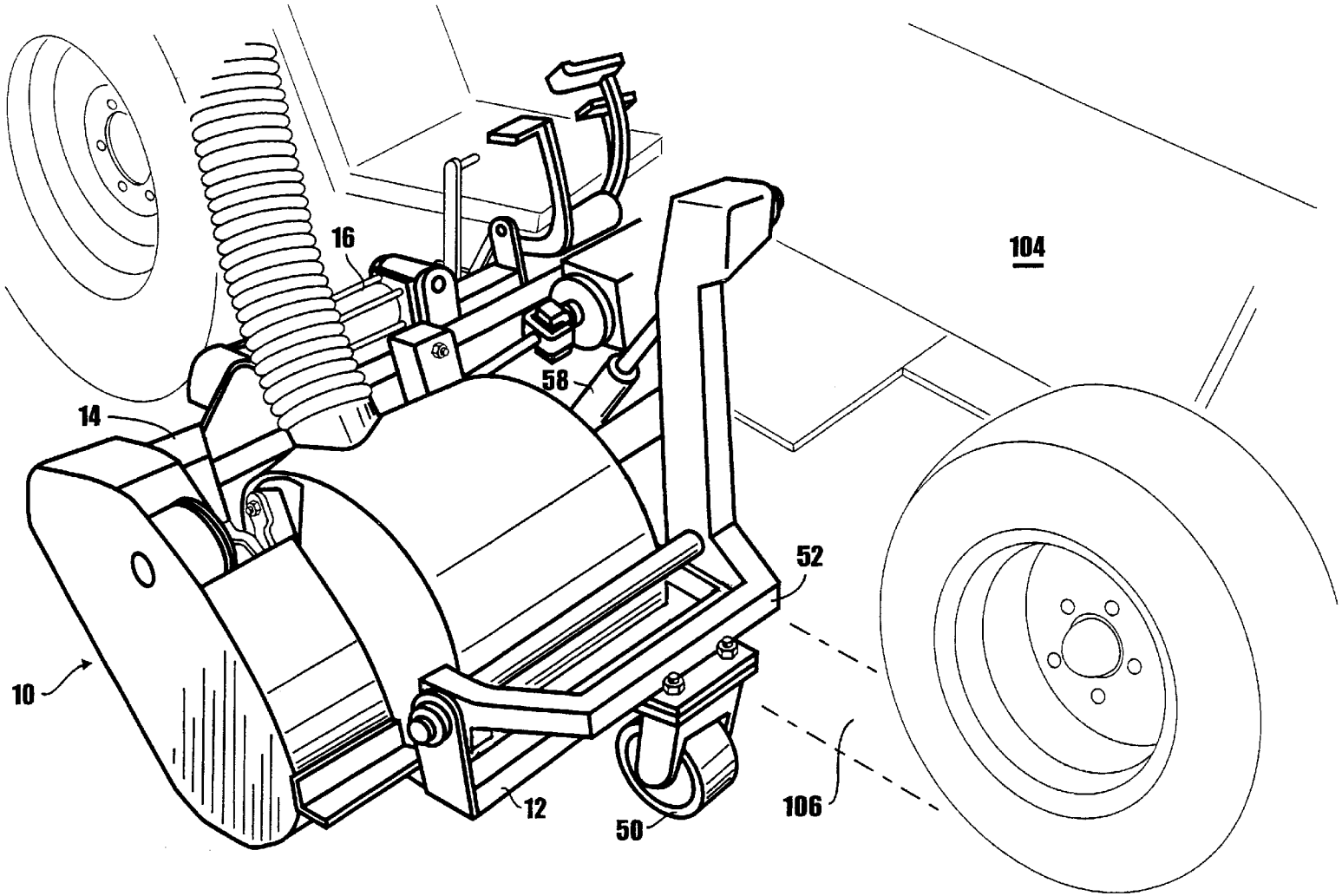
FIG. 1 is a perspective side view the implement of the present invention showing the guide wheel supported on an auxiliary frame pivotably separated from the implement second frame, lifting the wheel from the second frame and effectively lowering the second frame into a grinder brush cutting position. The implement is shown with a cover over the grinder brush and a vacuum exhaust to capture ground pavement.
Figure 2:
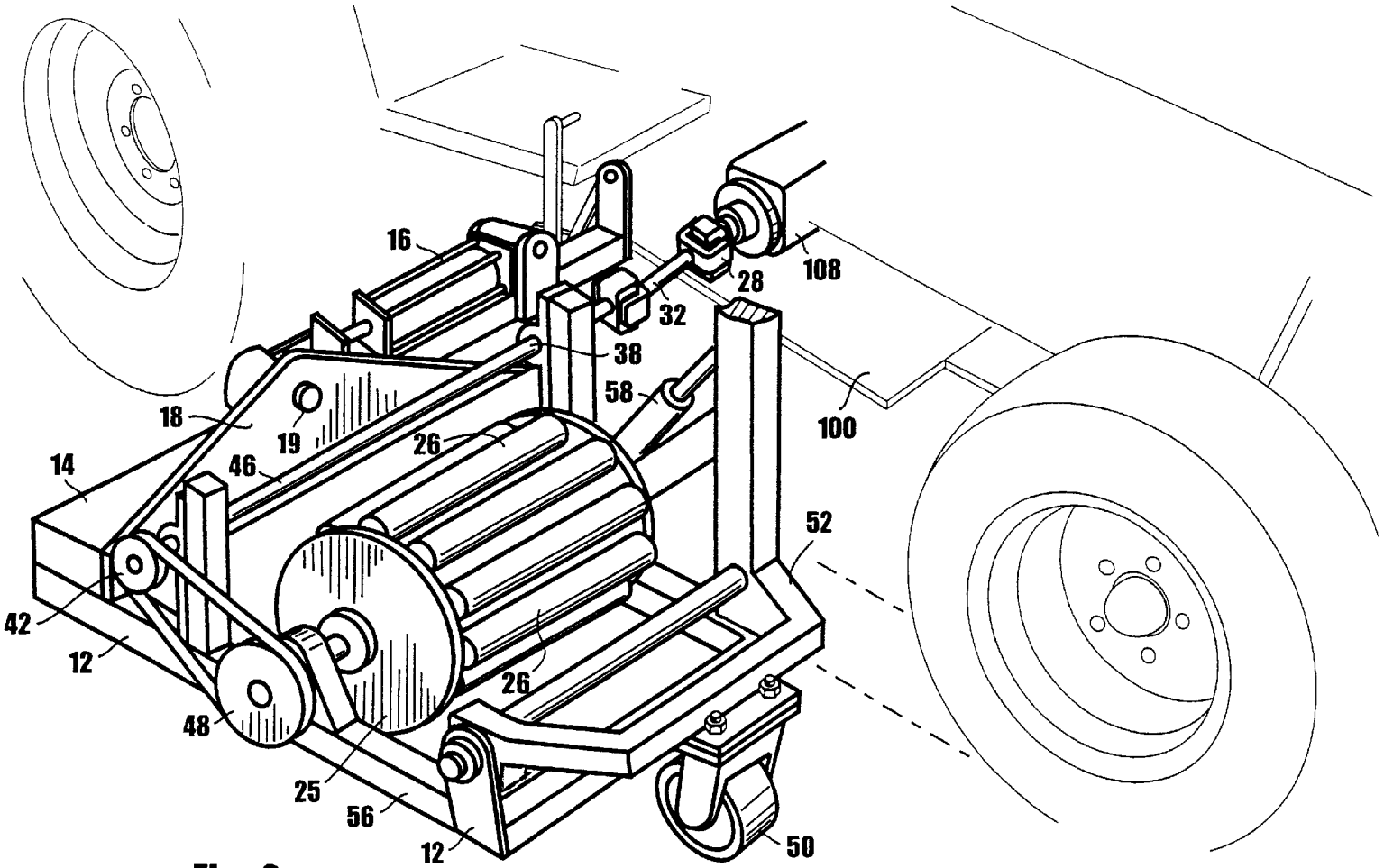
FIG. 2 is the implement of FIG. 1 without the cover to show a first hydraulic cylinder supporting the implement from the tractor secondary frame and a tractor power take-off driving the grinder brush mechanically connected through belted pulleys and universal joints that accommodate raising and lowering of the implement by the first hydraulic cylinder while maintaining the mechanical connection to the brush. The second hydraulic cylinder is also shown in position to pivot the guide wheel auxiliary frame on the second frame.
Figure 3:
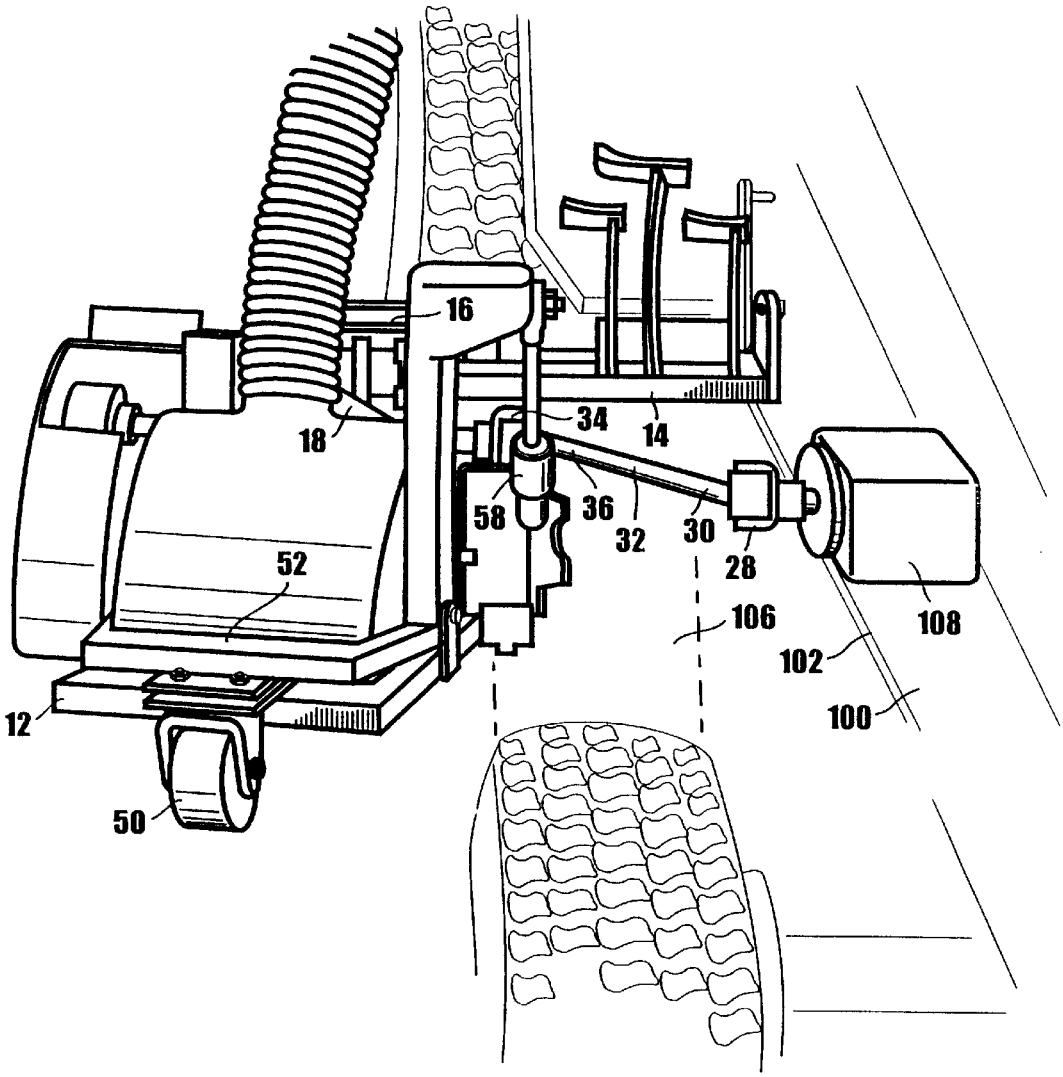
FIG. 3 is the implement of FIG. 1 shown with the auxiliary frame lowered to the second frame, effectively raising the implement and its grinding brush within from contact with underlying pavement.
Figure 4:
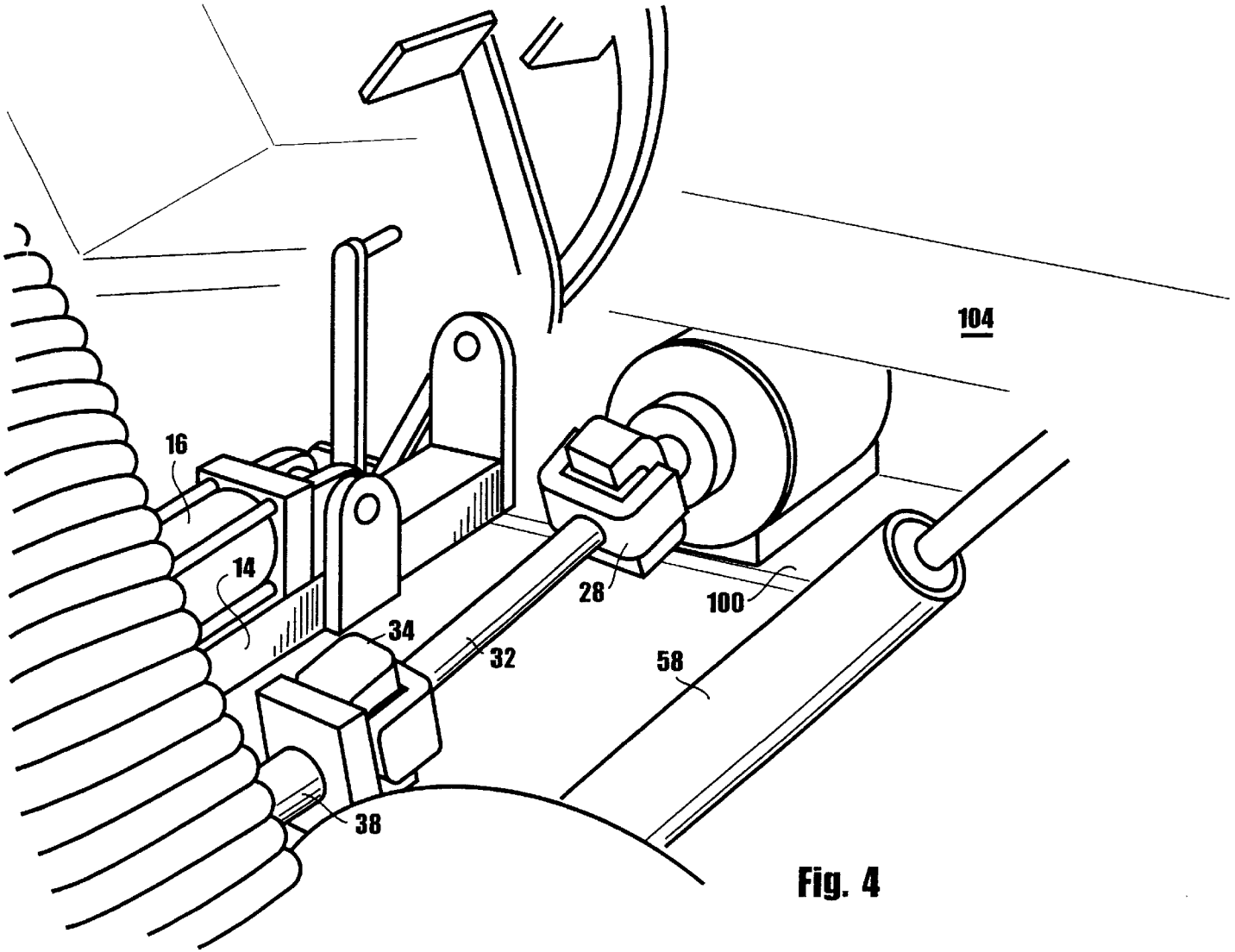
FIG. 4 shows the first hydraulic cylinder mounted to the tractor secondary frame and the tractor power take-off connected to a pulley drive shaft through a pair of universal joints.
Figure 5:
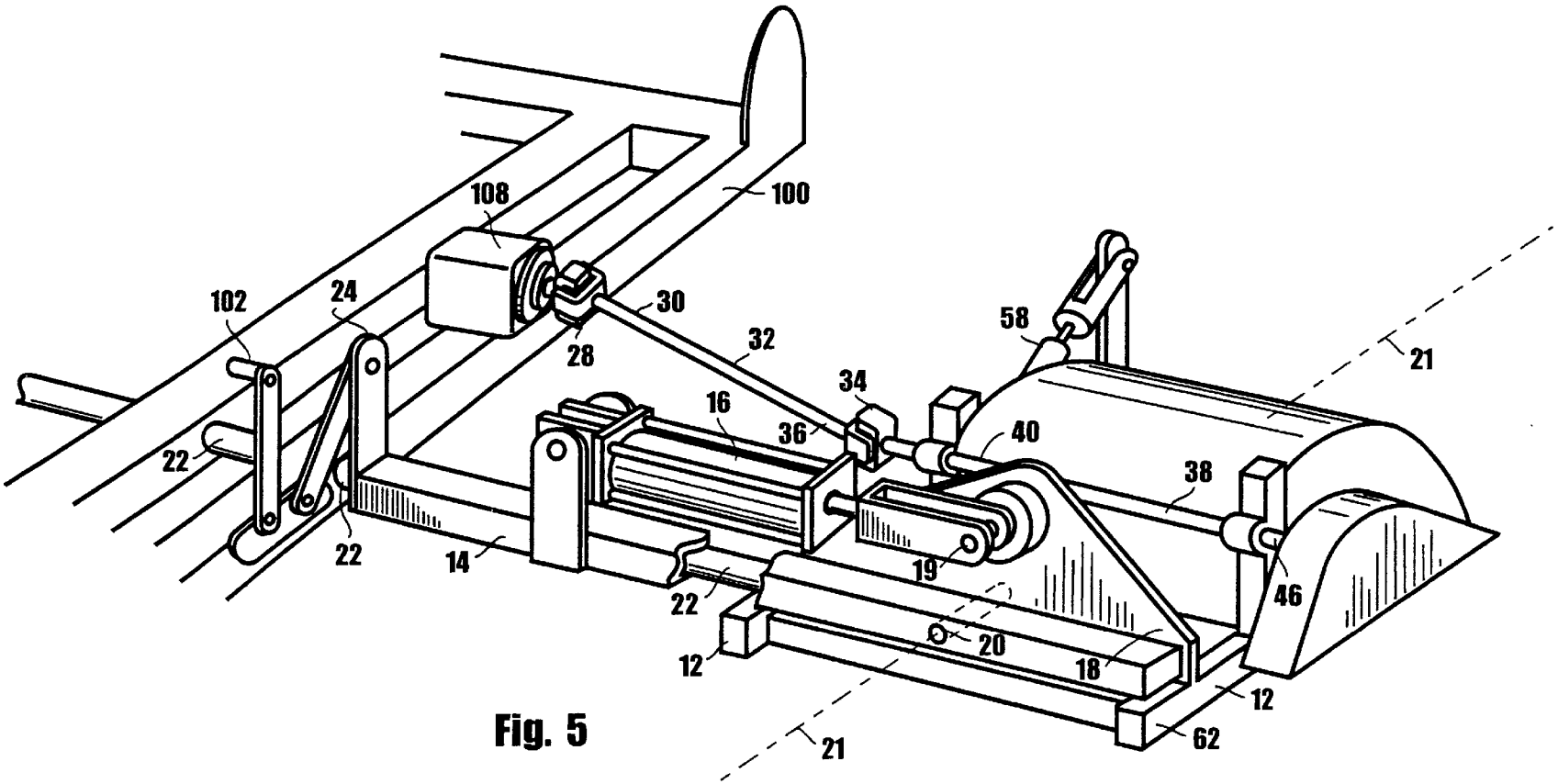
FIG. 5 is a rear perspective view of the tractor implement of FIG. 1 showing the tractor implement control, the pivot pin extending orthogonally from the tractor secondary frame to rotatably support the implement first frame on which the first hydraulic cylinder is mounted to adjust the implement second frame in roll on a pivot pin extending between the implement first and second frames.

The tractor implement 10 for grinding a pavement surface in removing paint lines comprises an implement adapted to mount to a side 102 of a tractor secondary frame 100. The tractor secondary frame is mounted under a conventional rubber-wheeled tractor 104 to support the implement outside of tractor wheel tracks 106.

The implement comprises a second frame 12 pivotably connected in roll to an implement first frame 14. A first hydraulic cylinder 16 mounted on the implement first frame 14 orthogonal to the tractor secondary frame 100 pivotably connects to the implement second frame 12 on lever plate 18 through pivot member 19, which lever plate is mounted to and extends above the implement second frame 12 and substantially across the second frame transversely such that actuation of the first hydraulic cylinder 16 causes the implement second frame 12 to pivot in roll relative to the implement first frame 14 on a pivot pin 20 connected therebetween. Connection of the first hydraulic cylinder is transversely central in pivot plate 18 and the pivot pin 20 lies directly below the connection. Thus actuation of the first hydraulic cylinder 16 causes the implement second frame 12 to rotate and adjust in roll about a longitudinal axis 21 through the center of the implement second frame.

A cylindrical rod 22 extends orthogonally from the tractor secondary frame 100 and rotatably through the implement first frame 14. A first frame lever bar 24 is mechanically connected to a tractor implement control 102 that rotates the lever on operator command, therein rotating the implement first frame 14 on the cylindrical rod 22 in providing for pitch adjustment of the implement.

A cylindrical grinder brush 25 is rotatably mounted on implement second frame 12 transverse to machine travel. A plurality of grinder elements 26 project generally radially along the grinder circumference.

A first universal joint 28 on a first end 30 of a connector bar 32 is disposed to connect pivotably at a tractor power take-off 108. A second universal joint 34 on a second end 36 of the connector bar 32 connects pivotably to a pulley drive shaft 38 at a pulley drive shaft first end 40. Thus, the universal joints enable roll and pitch adjustment of the second frame while maintaining connection between the pulley drive shaft first end 40 and the power take-off 108. A first pulley 42 connects to the pulley drive shaft 38 at a shaft second end 46, and a second pulley 48 connects to the grinder brush 25 with a pulley belt 50 running between the pulleys such that the tractor power take-off 108 causes the grinder brush 25 to rotate.

In operation, implement is lowered into operational position by action of the tractor control 102 with the grinder brush 25 near but in noncontact with underlying pavement with the implement. The grinder brush 25 is then adjusted into engagement and disengagement with the underlying pavement while the second frame 12 is maintained in operational position by action of a guide wheel 50. A guide wheel auxiliary frame 52 is pivotably mounted forward on the implement second frame 12 on pivot rod 54. With the guide wheel depending from the auxiliary frame 52 forward of the grinder brush 25, the guide wheel 50 remains in contact with underlying pavement when the second frame 12 is lowered into and maintained in operational position, supporting the second frame at its forward end 56.

A second hydraulic cylinder 58 connects between the second frame 12 and the auxiliary frame 52 through an auxiliary lever arm 60 extending vertically from the auxiliary frame 52 to control positioning of the auxiliary frame 52 relative to the second frame 12. As the second hydraulic cylinder 58 is actuated, it acts on the auxiliary lever arm 60 to lift and lower the auxiliary frame 52 about the second frame 12 as the auxiliary frame 52 pivots on the pivot rod 54. With the guide wheel 50 mounted on the auxiliary frame 52 while supporting the second frame 12 on underlying pavement, as action of the second hydraulic cylinder 58 causes the auxiliary frame 52 to move relative to the second frame 12, the auxiliary frame 52 generally maintains a constant vertical position as the guide wheel 50 rides on the pavement while the second frame 12 vertically moves under it own weight between engagement and disengagement of the grinding brush with underlying pavement. The second frame 12 is supported freely floating high on its rearward end 62 by the first frame 14 on the cylindrical rod 22. Thus, the weight of the implement is primarily on the guide wheel 50 in operation, the weight of the implement acting to drive the grinder brush 25 into underlying pavement. The depth of the penetration of the grinder brush into pavement is that of the relative movement between the implement auxiliary and second frames.

Typically a tractor operator actuates the tractor control 102 to lift the implement and the grinder brush above the pavement to interrupt pavement grinding. Similarly, the operator lowers the implement into grinding contact with the pavement when desired, the operator remaining in full control of the grinding action of the brush, determining when to cut into the pavement.

Having described the invention, what is claimed is as follows:

1. A tractor implement for grinding surface pavement in removing paint lines adapted to be attached to a tractor with a frame, a tractor implement control, and a tractor power take-off, comprising, an implement first frame, a rod mounted orthogonally to the tractor frame and passing rotatably through the implement first frame, a first frame lever bar extending from the implement first frame and mechanically connected to the tractor control such that rotation of the tractor control causes the implement first frame to rotate, therein providing a pitch adjustment in the implement first frame relative to the tractor sufficient to move the implement first frame between a travel position with the implement lifted above underlying pavement and an operational position with the implement lowered toward the pavement, a grinder brush rotatably mounted on the first frame and driven transverse to tractor travel by mechanical connection to the power take-off, means for adjusting the grinder brush into engagement and disengagement with the pavement while the first frame is maintained in operational position.

2. The tractor implement of claim 1 wherein the implement first frame is adapted to connect to the tractor at a tractor side and the mechanical connection to the power take-off is adapted to connect to said power take-off at said tractor side.

3. The tractor implement of claim 2 wherein said implement is mountable outside of tractor wheels with the grinder brush extending away from the tractor to reach pavement outside of wheel tracks.

4. The tractor implement of claim 1 further comprising an implement second frame with said grinder brush mounted to said second frame, a pivot pin pivotably mounted between the implement first and second frames axially orthogonal to the rod, the implement second frame pivoting on the pivot pin therein giving the second frame and grinder brush mounted thereon an adjustment in roll relative to the first frame.

5. The tractor implement of claim 4 further comprising a first hydraulic cylinder mounted on said implement first frame parallel to said rod and pivotably connected to the implement second frame such that actuation of the first hydraulic cylinder causes the implement second frame to pivot in roll relative to the implement first frame on said pivot pin connected therebetween.

6. The tractor implement of claim 5 further comprising a lever plate mounted to and extending above the implement second frame to which the first hydraulic cylinder is pivotably connected, the first hydraulic cylinder connected central in the lever plate with the pivot pin below and transversely central in the second frame such that the second frame adjusts in roll about a longitudinal axis passing through its center.

7. The tractor implement means of claim 1 further comprising a pulley drive shaft mechanically connected to the power take-off, a first pulley connected to a pulley drive shaft, a second pulley connected to the grinder brush, and a belt between the two pulleys such that the grinder brush and second pulley are rotated by rotation of the first pulley by the drive shaft.

8. The tractor implement of claim 4 in which the means for adjusting the grinder brush into engagement and disengagement with the pavement while the first frame is maintained in operational position comprises a guide wheel auxiliary frame pivotably mounted forward on the second frame, auxiliary frame pivoting means for pivoting the auxiliary frame ,relative to the second frame, a guide wheel depending from the auxiliary frame forward of the grinder brush in contact with underlying pavement when the second frame is lowered into and maintained in operational position, supporting and moving the second frame between engagement and disengagement of the grinding brush with underlying pavement as the guide wheel rides on the pavement, the auxiliary frame pivoting on the second frame by action of the auxiliary frame pivoting means.

9. The tractor implement of claim 4 in which said mechanical connection to the power take-off comprises a pulley drive shaft on the second frame, a first universal joint disposed to connect pivotably at the power take-off on a connector bar first end, a second universal joint on a connector bar second end disposed to connect pivotably to the pulley drive shaft at a shaft first end, said first and second universal joints disposed to enable roll adjustment of the second frame while maintaining connection between the shaft first end and the power take-off, a first pulley connected to the pulley drive shaft at a shaft second end, a second pulley connected to the grinder brush with a pulley belt running between the pulleys.

10. A tractor implement for grinding surface pavement in removing paint lines adapted to be attached to a tractor with a frame, a tractor implement control, and a tractor power take-off, comprising, an implement first frame, a rod mounted orthogonally to the tractor frame at a tractor side and passing rotatably through the implement first frame, a first frame lever bar extending from the implement first frame and mechanically connected to the tractor control such that rotation of the tractor control causes the implement first frame to rotate, therein providing a pitch adjustment in the implement first frame relative to the tractor sufficient to move the implement first frame between a travel position with the implement lifted above underlying pavement and an operational position with the implement lowered toward the pavement, an implement second frame, a pivot pin pivotably mounted between the implement first and second frames axially orthogonal to the rod, the implement second frame pivoting on the pivot pin therein giving the second frame and grinder brush mounted thereon an adjustment in roll relative to the first frame, a grinder brush rotatably mounted on the second frame transverse to tractor travel and driven by mechanical connection to the power take-off at said tractor side, said mechanical connection including a pulley drive shaft on the second frame, a first universal joint disposed to connect pivotably at the power take-off on a connector bar first end, a second universal joint on a connector bar second end disposed to connect pivotably to the pulley drive shaft at a shaft first end, said first and second universal joints disposed to enable roll adjustment of the second frame while maintaining connection between the shaft first end and the power take-off, a first pulley connected to a pulley drive shaft at a shaft second end, a second pulley connected to the grinder brush, and a belt between the two pulleys such that the grinder brush and second pulley are rotated by rotation of the first pulley by the drive shaft, a first hydraulic cylinder mounted on said implement first frame parallel to said rod and pivotably connected to the implement second frame such that actuation of the first hydraulic cylinder causes the implement second frame to pivot in roll relative to the implement first frame on the pivot pin, means for adjusting the grinder brush into engagement and disengagement with the pavement while the primary frame is maintained in operational position.

11. The tractor implement of claim 10 further comprising a lever plate mounted to and extending above the implement second frame to which the first hydraulic cylinder is pivotably connected, the first hydraulic cylinder connected central in the lever plate with the pivot pin below and transversely central in the second frame such that the second frame adjusts in roll about a longitudinal axis passing through its center.

12. The tractor implement of claim 10 in which the means for adjusting the grinder brush into engagement and disengagement with the pavement while the first frame is maintained in operational position comprises a guide wheel auxiliary frame pivotably mounted forward on the second frame, auxiliary frame pivoting means for pivoting the auxiliary frame relative to the primary frame, a guide wheel depending from the auxiliary frame forward of the grinder in contact with underlying pavement when the second frame is lowered into and maintained in operational position, supporting and oscillating the second frame between engagement and disengagement of the grinding brush with underlying pavement as the guide wheel rides on the pavement, the auxiliary frame pivoting on the second frame by action of the auxiliary frame pivoting means.

* * * * *